US006575736B1

(12) United States Patent
Aust et al.

(10) Patent No.: US 6,575,736 B1
(45) Date of Patent: Jun. 10, 2003

(54) INFRARED RADIATOR THAT IS DESIGNED AS SURFACE RADIATOR

(75) Inventors: Richard Aust, Mönchengladbach (DE); Herbert Sommer, Düsseldorf (DE)

(73) Assignee: Kreiger GmbH & Co. KG, Monchengladbach (DE)

( * ) Notice: Subject to any disclaimer, the term of this patent is extended or adjusted under 35 U.S.C. 154(b) by 0 days.

(21) Appl. No.: 09/889,452

(22) PCT Filed: Dec. 17, 1999

(86) PCT No.: PCT/EP99/10034

§ 371 (c)(1),
(2), (4) Date: Jul. 12, 2001

(87) PCT Pub. No.: WO00/42356

PCT Pub. Date: Jul. 20, 2000

(30) Foreign Application Priority Data

Jan. 14, 1999 (DE) ..... 199 01 145

(51) Int. Cl.[7] ..... F23D 14/12; F23D 14/14
(52) U.S. Cl. ..... 431/328; 431/329
(58) Field of Search ..... 431/328, 329

(56) References Cited

U.S. PATENT DOCUMENTS 3,751,213 A * 8/1973 Sowards ..... 431/328
3,857,670 A * 12/1974 Karlovetz et al. ..... 431/329
5,251,609 A * 10/1993 Thibault et al. ..... 126/39 J
5,326,257 A 7/1994 Taylor et al.
5,525,056 A * 6/1996 Sutton ..... 431/114
5,685,708 A * 11/1997 Palmer-Jones ..... 431/114
5,989,013 A * 11/1999 Gray ..... 126/92 AC
5,993,200 A * 11/1999 Palmer-Jones ..... 431/328
6,159,001 A * 12/2000 Kushch et al. ..... 122/4 D
6,213,757 B1 * 4/2001 Kushch et al. ..... 122/4 D
6,394,789 B1 * 5/2002 Yabuuchi et al. ..... 431/170

FOREIGN PATENT DOCUMENTS

| | | |
|---|---|---|
| EP | 0 536 706 A2 | 4/1983 |
| WO | WO 96/41101 | 12/1996 |
| WO | WO 98/33013 | 7/1998 |

* cited by examiner

*Primary Examiner*—Henry Bennett
*Assistant Examiner*—Alfred Basichas
(74) *Attorney, Agent, or Firm*—Herbert Dubno

(57) ABSTRACT

An infrared irradiating heater having a radiating body with a housing comprised of a ceramic and having a planar radiating surface, a multiplicity of substantially flame-free passages extending perpendicular to the surface and opening at the surface, and a rear surface, the passages extending to the rear surface, the passages having lengths less than 300 mm, the total cross sectional area of the passages at the planar radiating surface being in a ratio to the area thereof in excess of 50%, and the passages having length to maximum diameter ratios of at least 5. A burner plate spaced from the rear surface defines a combustion chamber with it so that the combustion is effected substantially only in this combustion chamber and the passages are free from flame and serve as radiator surfaces.

8 Claims, 8 Drawing Sheets

INFRARED RADIATOR THAT IS DESIGNED AS SURFACE RADIATOR

CROSS REFERENCE TO RELATED APPLICATIONS

This application is a national stage of PCT/EP99/10034 filed Dec. 17, 1999 and based upon German application 199 01 145.1 filed Jan. 14, 1999 under the International Convention.

FIELD OF THE INVENTION

The invention relates to an infrared radiator configured as a surface radiator with a radiating body which, at its rear side, is heated by a burning fluid-air mixture and whose front surface emits the infrared radiation.

STATE OF THE ART

Infrared radiators configured as surface radiators are used in known manner in dryer systems for the drying of web shaped materials, for example, paper webs or cardboard webs. Depending upon the width of the web to be dried and the desired heating power, the requisite number of radiators with flush emitting surfaces are assembled into a drying unit.

In the publication "Radiant efficiency and performance considerations of commercially manufactured gas radiant burners (Speyer et al., Exp. Heat Trans, 9, 213–245, 1996), various types of gas heated infrared radiators are compared with one another. A radiator is proposed which, among others, has a ceramic plate provided with holes through which a gas/air mixture flows and which burns on its surface. To avoid a migration of the flame and to increase the radiation efficiency, a metal grid is arranged ahead of the ceramic plate.

This known principle, which is used by many manufacturers, has the drawback that the radiation efficiency is comparatively small because of the low emission coefficient of the ceramic plate at high temperatures. In addition, the metal grid has only a limited life when the radiator is operated at high powers.

OBJECT OF THE INVENTION

The object of the invention is to provide an infrared radiator configured as a surface radiator which has a high efficiency at temperatures above 1100° C. and a long operating life.

SUMMARY OF THE INVENTION

This object is achieved with an infrared radiator configured as a surface radiator with a radiating body (15) which is heated at its rear side by a burning liquid/air mixture and from its front surface emits the infrared radiation. According to the invention the radiating body includes a multiplicity of throughgoing passages functioning as hollow space irradiators, in which the wall area/cross sectional area ratio in the flame-free region is greater than 10, preferably greater than or equal to 20.

Advantageously the passages are of circular cross section or are configured in the form of regular polygons whereby the length/maximum diameter ratio in the flame-free region is greater than 3, preferably greater than or equal to 5.

The radiating body can be constructed from a row of plates arranged in a spaced relationship to one another, whose intervening spaces form the passages, whereby the height of the plate/spacing between neighboring plates form a ratio in the flame-free region which is greater than 3, preferably greater than or equal to 5.

The proportion of the opening area of the passages to the total area of the front side of the radiating body amounts to at least 30%, preferably more than 50%.

The radiating body is preferably fabricated from ceramic.

The passages can have a depth less than 300 mm, preferably between 10 mm and 100 mm.

Advantageously the passages have a cross section widening toward the front side.

A burner plate can be spaced from the radiating body to form a combustion chamber therewith.

The radiating body can be made from a silicon carbide reinforced with carbon fibers.

The infrared body is preferably used for drying of web-shaped materials, especially paper webs or cardboard webs.

The invention makes use of the physical effect that a channel forming hollow radiator has at its opening an emission factor which increases with its ratio of wall area/cross sectional area. With a wall area/cross sectional area ratio greater than or equal to 20, a channel shaped hollow chamber radiator can have an emission factor of approximately 1 when it is fabricated from a ceramic with an emission factor of about 0.5.

BRIEF DESCRIPTION OF THE DRAWING

The drawing serves to elucidate the invention based upon embodiments shown in a simplified manner. In the drawing.

MANNER OF CARRYING OUT THE INVENTION

The infrared radiator according to the invention is preferably heated with gas. Alternatively heating with a liquid fuel as heating fluid is possible.

Figure 1:
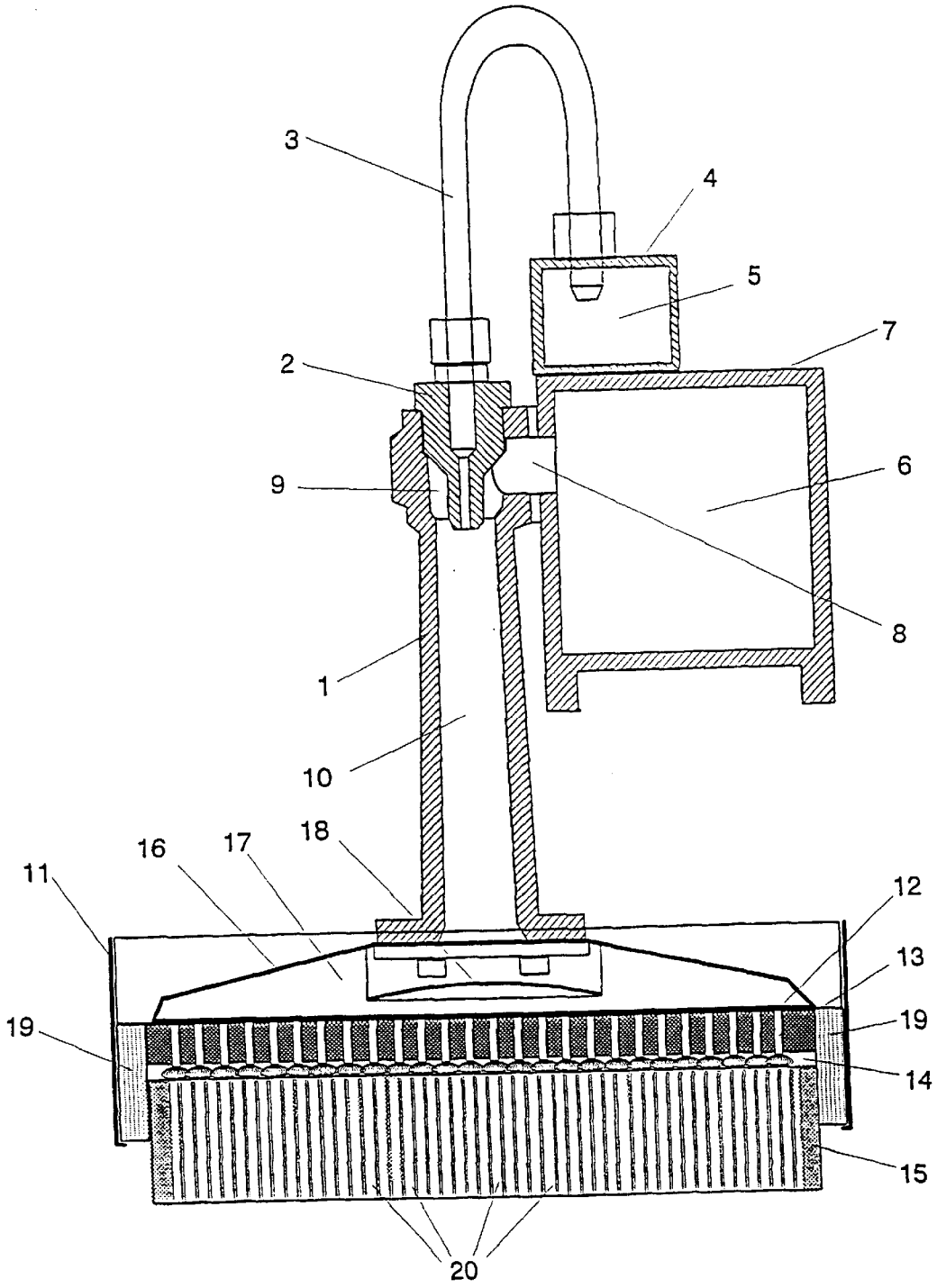
FIG. 1 is a cross section of the basic construction of an infrared radiator.

As shown in FIG. 1, each radiator includes a mixing pipe 1 into which a mixing nozzle 2 is screwed at one end. A gas feed line 3 is connected to the mixing nozzle 2 and is connected with a manifold 4 from which a plurality of mutually adjacent radiators are supplied with gas 5.

The supply of air is effected via a hollow traverse 7 on which the mixing pipe 1 is fastened. The connecting duct 8 for the air feed opens in the upper part of the mixing pipe 1 into a downwardly open air chamber 9 which surrounds the outlet ends of the mixing nozzles 2 so that in the mixing chamber 10 of the mixing pipe 1 a gas/air mixture is introduced from above.

At the lower open end of the mixing pipe 1, a housing 11 is fastened in which a burner plate is arranged. The burner plate 12 has a row of throughgoing bores 13 which open into a burner chamber 14 which is formed between the burner plate 12 and a radiating body arranged substantially parallel to the burner plate 12 but spaced therefrom. The mixing pipe 1 opens into a chamber sealed off by a hood 16 which is closed at its other end by the burner plate 12. To distribute the gas/air mixture uniformly on the backside of the burner plate 12, a baffle plate 18 is arranged in the mixture distribution chamber 17 and the supplied mixture flows against it. The burner plate 12 and the radiating body 15 are fitted into the housing in a peripherally continuous refractory seal 19 which laterally closes the combustion chamber 14.

The radiating body 15 is preferably fabricated from ceramic, especially aluminum oxide or zirconium oxide, aluminum titanate, corundum or mullite. Silicon carbide has been found to be especially suitable, particularly when it is reinforced with carbon fibers.

Alternatively, the radiating body 15 can also be fabricated from a heat-resistant metal.

It is important for the invention that the radiating body 15 contain a multiplicity of throughgoing passages 20 which are effective as hollow space radiators. The passages 20 are heated at the rear side of the radiating body 15 which bounds the combustion chamber 14 and are substantially flame-free; the gas-air mixture burns essentially only in the combustion chamber 14. So that the passages 20 as hollow space radiators will have a high emission factor, the ratio of their areas to their cross sectional areas is, in their flame-free regions, greater than 10 and preferably $\geqq 20$.

Figure 7:
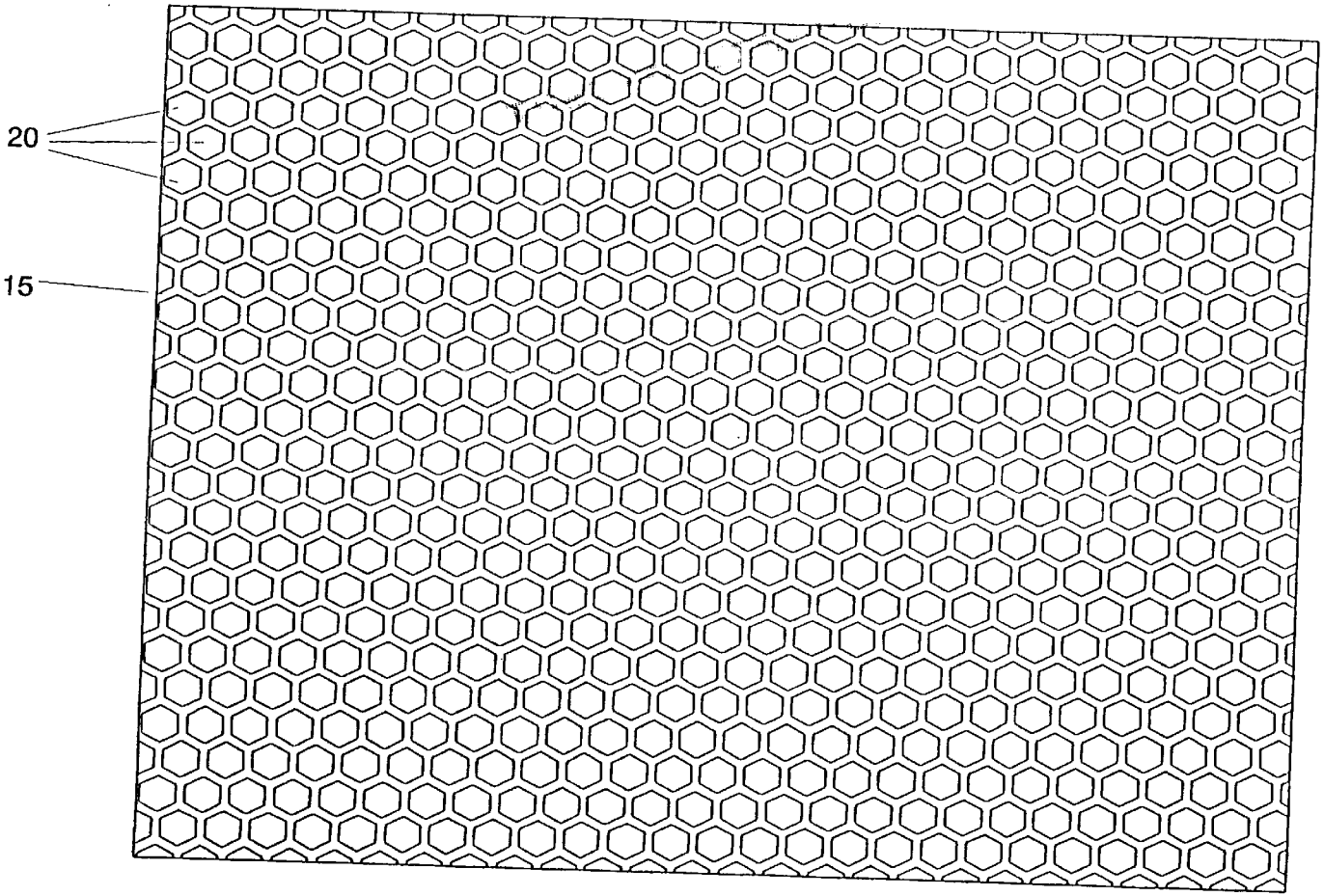
Figure 8:
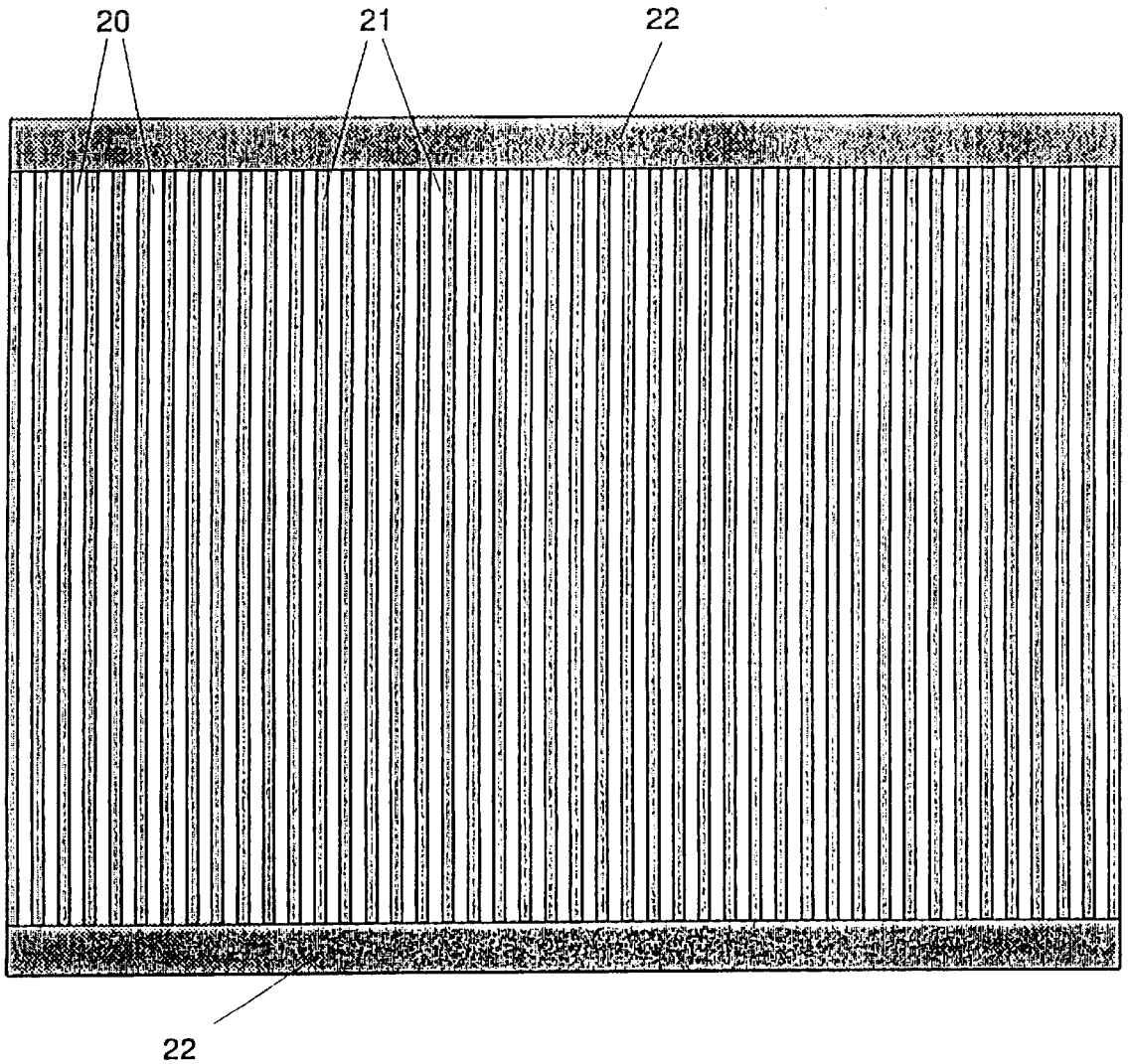
FIGS. 8 and 9 are diagrams of in infrared radiator with slip shaped channels in the radiating body.

The passages 20 are either tubular (FIGS. 2 to 7) or slit shape (FIG. 8). The cross section of the tubularly-shaped passages is preferably either circular or in the form of a regular polygon. With tubularly-shaped passages 20, the length/maximum diameter ratio in the flame-free region is greater than 3 and preferably is greater than/equal to 5. Alternatively, the passages 20 can also be configured as slit-shaped as shown in FIG. 8. Preferably with this embodiment of the radiation body, the radiation body 15 is constructed from a row of spaced-apart plates 21 whose intervening spaces form the slit-like passages 20. The spacing of two neighboring plates 21 is in a ratio to the lengths of the plates 21 in the flame-free region which amounts, in this embodiment, to greater than 3, preferably greater than/equal to 5. The lengths of the passages 20 are, in all embodiments, measured from the heated rear side of the radiation body 15 in the direction toward the radiating front surface; in FIG. 1 it is measured from above downwardly. The lengths of the passages 20 amounts to less than 300 mm, preferably toward 10 mm to 100 mm. In the exemplary embodiment the length amounts to about 40 mm.

So that higher efficiency can be achieved, at the front side of the radiation body 15 shown in the lower part of FIG. 1, the proportion of the opening area of the passages 20 serving as radiation surfaces of the entire area of the front side is at least 30%; preferably the proportion of the opening area amounts to more than 50% of the total area of the front side.

Figure 3:
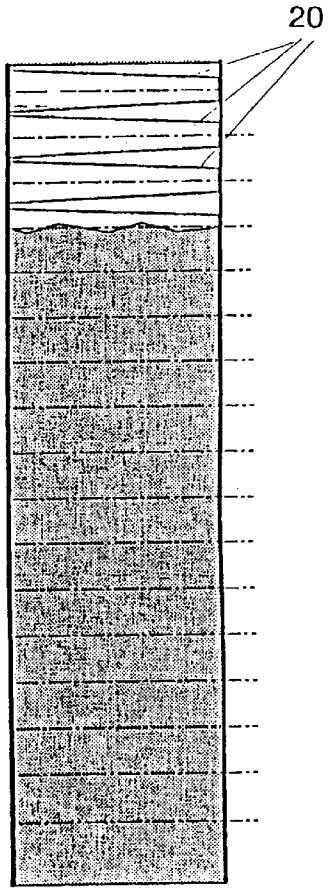
FIG. 3 a section through the radiating body of FIG. 2.

Preferably the passages widen toward the rotating front side as is shown in FIG. 3. A diffuser-like widening of the passage 20 effects a more uniform heat distribution and reduces thereby stresses in the radiating body 15.

The combustion chamber 14 ensures that the combustion will occur over the entire rear side area of the radiating body 15. The flame can propagate laterally. In an alternative embodiment without a separate combustion chamber, the passages 20 are connected together at the rear side of the radiating body 15 by transversely running passages. The flames burn, in this embodiment, at the inlet portion of the passages 20 at the rear sides of the radiating body 15 whereby transverse passages ensure uniform distribution of the flames over the entire back side of the radiating body 15. In this embodiment the values of the area proportions or length proportions of the passages pertain to the flame-free portions.

With all of the radiating bodies 15 shown in the Figures, the radiating front side is about 200 mm in width and about 150 mm in height.

In FIGS. 2–7 various embodiments have been shown of radiating bodies 15 with throughgoing passages 20. The cross section of the passages 20 is either circular in the form of a regular polygon. The ratio of the length to the maximum diameter of the passages in the flame-free region amounts to more than 3 and preferably is greater than or equal to 5.

Figure 2:
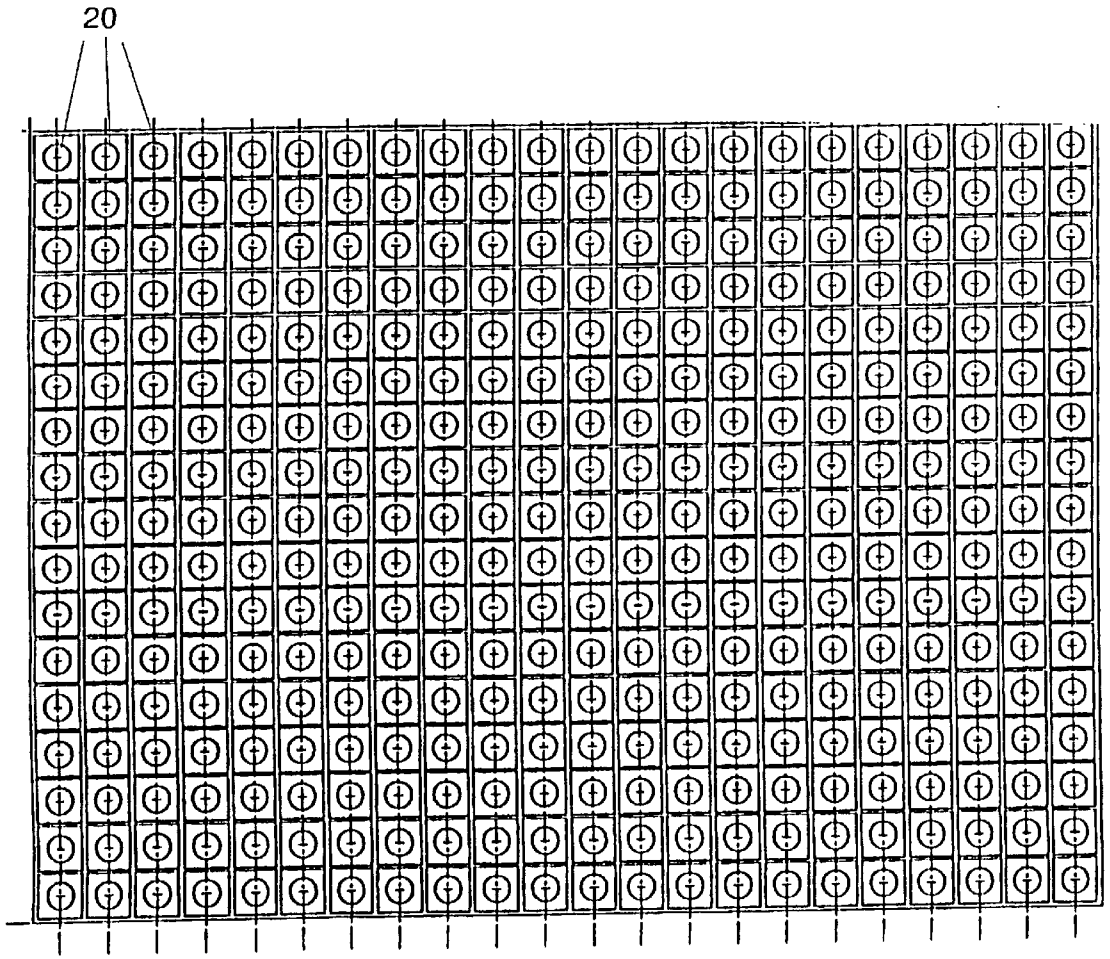
FIG. 2 is a plan view of the radiating front side of a radiation body.

In the embodiment according to FIGS. 2 and 3, the passages are so configured that they widen from a circular cross section to about 4 mm in diameter to a square opening area with a side length of about 8 mm. The passages 20 are so arranged in a uniform pattern over one another and adjacent one another that on the front side webs of about 2 mm in thickness remain.

Figure 4:
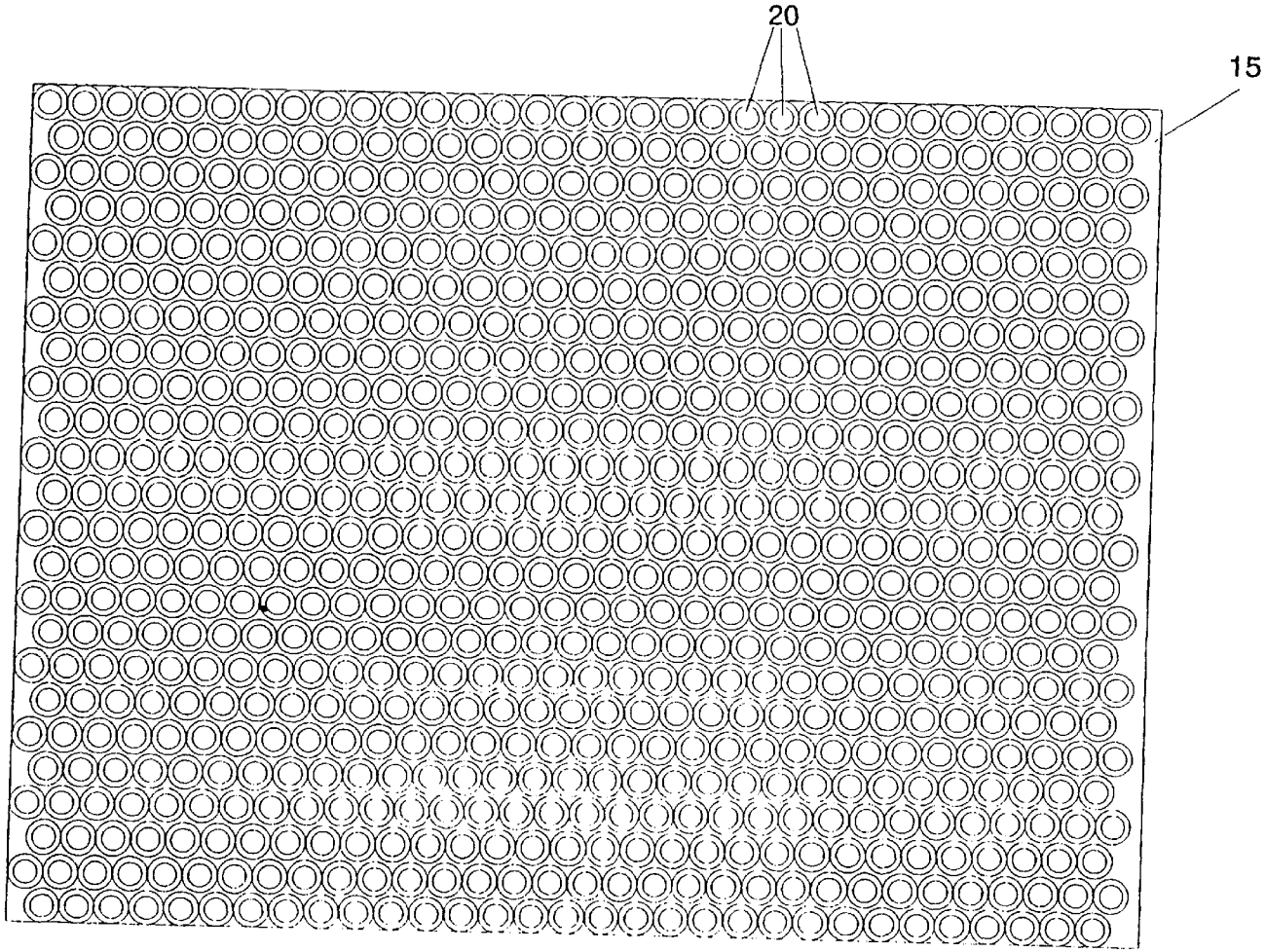
FIGS. 4 to 7 are respective plan views of the radiating front side of different embodiments of a radiating body with tubular channels.
Figure 5:
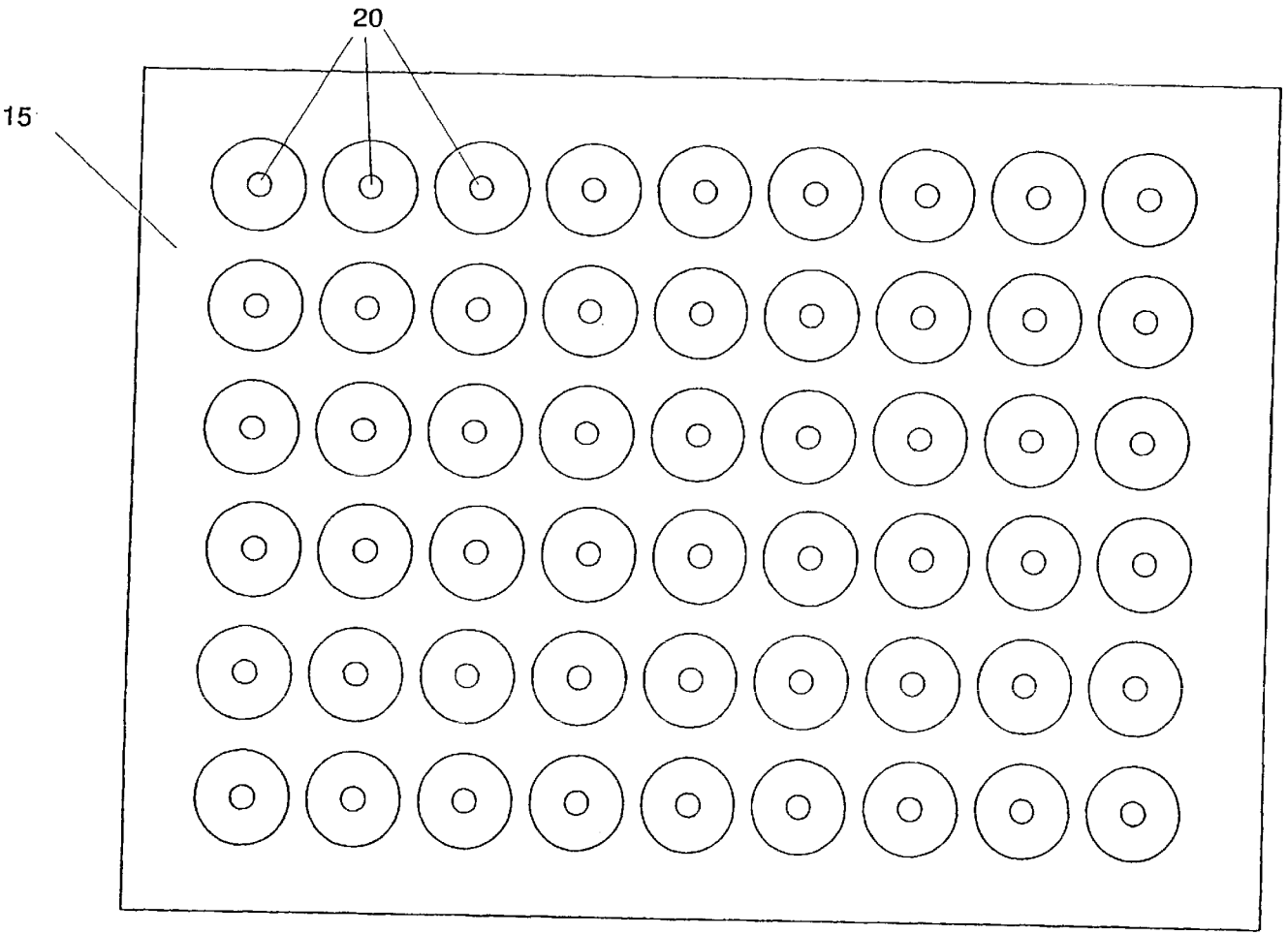

In the embodiment of FIG. 4, the mouth openings of the passages 20 are circular with a diameter of about 5 mm. The walls around the mouth openings of the passages 20 are circular. In order to have the passages 20 as densely packed as possible, they are arranged in a face-centered pattern. In the embodiment of FIG. 5, they widen over their entire lengths in circular cross section passages with a diameter to about 4 mm to a mouth diameter of about 15 mm. The result is fewer passages 20 with a larger mouth diameter than with the embodiment according to FIG. 4.

Figure 6:
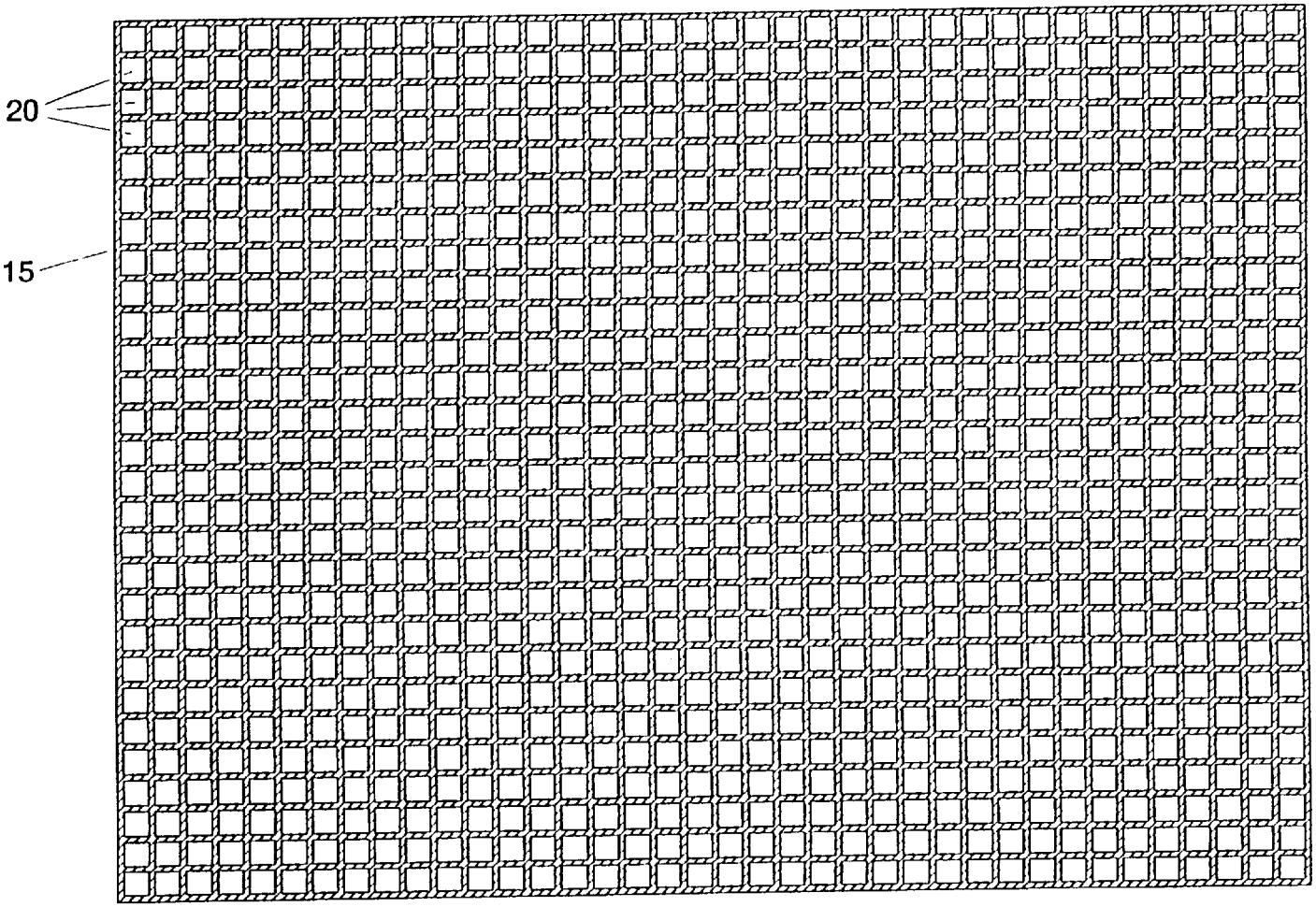

FIGS. 6 and 7 show radiating bodies in which the passages are of square cross section (FIG. 6) or hexagonal cross section. The overall radiating body 15 is honeycomb-shaped with throughgoing passages 20.

Figure 9:
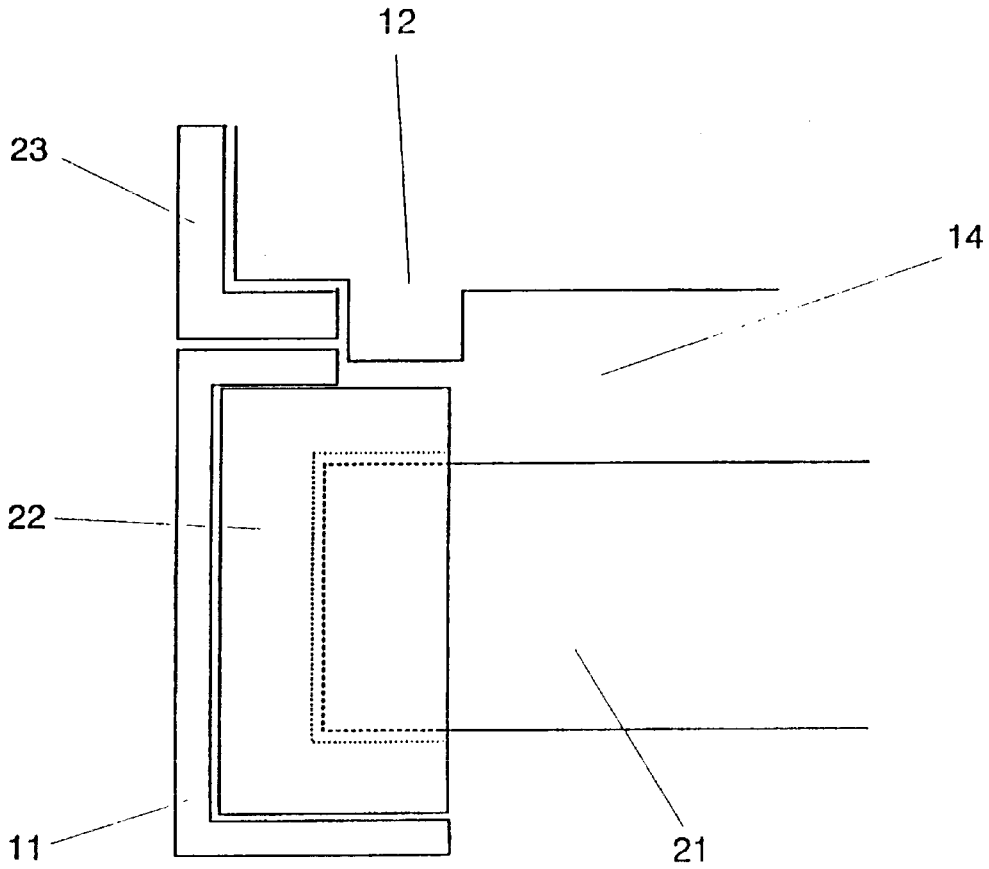

FIGS. 8 and 9 show a radiating body which has a row of slit-like passages 20. The slit-shaped passages 20 extend preferably over the entire width of the radiating body 15. They are preferably so produced by arranging a row of plates 21 of ceramic with spacings from one another. The intervening spaces between the plates 21 in this embodiment, the plates 21 are so arranged that the ratio of the height of the plate 21 to the distance between two neighboring plates 21 in the flame-free region is greater than 3 and is preferably greater than or equal to 5. The heights of the plates 21 are defined in the radiating direction and thus in FIG. 1 run from top to bottom.

The construction of an infrared radiator with such a radiating body 15 has been illustrated in a partial view in FIG. 9.

The housing 11 is comprised of a metal holder frame which, on each longitudinal side, holds a respective ceramic bar 22. Each of the ceramic bars is formed on the respective inner side with slit-shaped openings in each of which a ceramic plate 21 is inserted with its lateral end and is thus held. In the view of FIG. 9, the plates 21 forming the radiating body are arranged above one another and below one another. The radiating body 15 emits the infrared radiation downwardly. A second metallic holding frame 23 holds the burner plate 12 which has only been indicated diagrammatically in FIG. 9. The burner plate 12 contains a row of bars 13 which open into a combustion chamber 14 as has already been described in elucidation of FIG. 1.

The embodiment according to FIGS. 8 and 9 has an advantage that the passages are formed from simply shaped plates 21. They can thus be fabricated from a temperature-resistant and stable material even when the same may be difficult to shape and/or to machine. An especially suitable material for the plates 21 has been found to be silicon carbide which has been reinforced by carbon fibers.

Based upon the possibility of using it at temperatures above 1100° C., its high specific power density and its long life, the infrared radiator of the invention is especially suitable for the drying of web-shaped materials at high speed. A preferred field of use is in the drying of travelling paper webs or cardboard webs in paper-making factories, especially downstream of coating units.

What is claimed is:

1. An infrared irradiating heater for drying paper and cardboard webs, said heater comprising:

a housing;

a radiating body in said housing comprised of a ceramic and having a planar radiating surface, a multiplicity of substantially flame-free passages extending perpendicular to said surface and opening at said surface, and a rear surface, said passages extending to said rear surface, said passages having lengths less than 300 mm, the total cross sectional area of said passages at said planar radiating surface being in a ratio to the area thereof in excess of 50%, and said passages having length to maximum diameter ratios of at least 5;

a burner plate in said housing spaced from said rear surface and defining a combustion chamber therewith, said burner plate being provided with throughgoing bores opening into said combustion chamber;

a peripherally continuous seal extending around perimeters of said burner plate and said radiating body and sealing said combustion chamber so that combustion in said heater is substantially confined to said combustion chamber;

a distribution chamber formed in said housing along a side of said burner plate opposite said combustion chamber for distributing a fuel/air mixture to said bores; and a mixing pipe supplied with fuel and air opening into said distribution chamber.

2. The infrared irradiating heater defined in claim 1 wherein said radiating body is composed of a ceramic selected from the group which consists of aluminum oxide, zirconium oxide, aluminum titanate, corundum, mullite and graphite-reinforced silicon carbide.

3. The infrared irradiating heater defined in claim 2, further comprising a baffle in said distribution chamber ahead of an outlet for said pipe to distribute said mixture in said distribution chamber.

4. The infrared irradiating heater defined in claim 3 wherein said passages are of circular cross section or of regular polygonal cross section.

5. The infrared irradiating heater defined in claim 3 wherein said passages are defined between a plurality of plates.

6. The infrared irradiating heater defined in claim 3 wherein said passages have lengths of 10 mm to 100 mm.

7. The infrared irradiating heater defined in claim 6 wherein said passages have lengths of about 40 mm.

8. The infrared irradiating heater defined in claim 7 wherein said passages have cross sections widening toward said planar radiating surface.

* * * * *